US005241288A

United States Patent [19]

Aria

[11] Patent Number: 5,241,288

[45] Date of Patent: Aug. 31, 1993

[54] ELECTROMAGNETIC SELECTOR EQUIPPED WITH A PLURALITY OF SELECTION POSITIONS

[75] Inventor: Piero Aria, Florence, Italy

[73] Assignee: Savio S.p.A., Pordenone, Italy

[21] Appl. No.: 797,127

[22] Filed: Nov. 22, 1991

[30] Foreign Application Priority Data

Nov. 23, 1990 [IT] Italy ..... 22171 A/90

[51] Int. Cl.[5] ..... H01H 9/00

[52] U.S. Cl. ..... 335/177; 66/219

[58] Field of Search ..... 335/177-184; 66/218, 219, 220, 221

[56] References Cited

U.S. PATENT DOCUMENTS 3,530,686 9/1970 Martinetz ..... 66/221
3,710,594 1/1973 Bourgeois ..... 66/220
3,948,062 4/1976 Sumitomo ..... 66/220
3,998,073 12/1976 Luth ..... 66/221
4,989,424 2/1991 Furia ..... 66/219

FOREIGN PATENT DOCUMENTS 0249203 12/1987 European Pat. Off. .
0343123 11/1989 European Pat. Off. .
0397254 11/1990 European Pat. Off. .
2568596 2/1986 France .
2043120 10/1980 United Kingdom .

*Primary Examiner*—Lincoln Donovan
*Attorney, Agent, or Firm*—Robert D. Schaffer

[57] ABSTRACT

An electromagnetic selector device comprising a single permanent magnet and a plurality of electromagnets, which are excited in contrast or in agreement with the permanent magnet, to form a plurality of selection positions on two fronts along which run the elements to be selected.

5 Claims, 2 Drawing Sheets

ELECTROMAGNETIC SELECTOR EQUIPPED WITH A PLURALITY OF SELECTION POSITIONS

The present invention relates to an electromagnetic selection device capable of holding or not holding, depending on the electrical excitation supplied to it, ferromagnetic elements which are brought close to it for very short periods.

These electromagnetic devices are widely used in the electro-mechanical industry and one of their typical applications is in circular knitting machines. The present description refers to this application, without any intention of limitation.

In circular knitting machines, the needles are selected by operating elements active in the said selection (comprising for example auxiliary jacks, rocker levers and flexible bars arranged to form a kinematic chain with each needle) which are held or not held and assume two alternative positions, which correspond to putting into operation or excluding from operation the corresponding needle.

These devices and procedures for selecting the needles in a circular knitting machine are described for example in U.S. patent application Ser. No. 07/766,417 of the present Applicant, in European Patent Application No. 219029 in the name of Lonati, in UK Patent Application No. 2112822 in the name of Elitex, in UK Patent in the name of Precision Fukuhara and in French Patent No. 1564603 in the name of Mayer.

The present invention is described with reference to the said specific application, which presents considerable difficulties as regards the speed at which the selection must be made, the problems of shortage of space, and the problems of synchronism with the other organs of the machine, but with the proviso that the electromagnetic selection device can be advantageously applied also in other areas of technology.

An electromagnetic selection device based on the combination of attraction by permanent magnets with concordant or contrasting attraction by electromagnets, depending on their excitation, is described in Czechoslovakian Inventor's Certificate No. 216358.

This device comprises a plate along the edge of which slide the active needle-selection elements, loaded with an elastic force which tends to pull them away from the said edge. The two external parts of the said edge comprise the pole shoes of a permanent magnet—which thus permanently exert an attractive action on the active elements that slide along the edge—while the central part of the said edge, magnetically isolated from the external parts, constitutes the pole shoe of an electromagnet which attracts or does not attract the active elements that slide along it, depending on the electrical excitation supplied to it, releasing them or holding them to make the selection the moment they pass through the central part.

According to U.S. patent application Ser. No. 07/766,417 of the present Applicant, this selection is performed by means of a plurality of electromagnetic selectors of the type described above, placing the said selectors on different levels and equipping the active selection elements with protrusions and/or indentations at the said levels.

There are considerable problems in using these electromagnetic selectors due to the limited availability of angular space for their arrangement preceding any supply of wire, and to the small distance between two successive active elements to be selected (which may be of the order of one millimeter or even less) and lastly to the limited axial space available for modulating the selection on the various levels of the selectors.

The present invention consists in a compact electromagnetic selector, equipped with a plurality of work positions which requires a minimum number of components and a minimum space for its arrangement.

Figure 1:
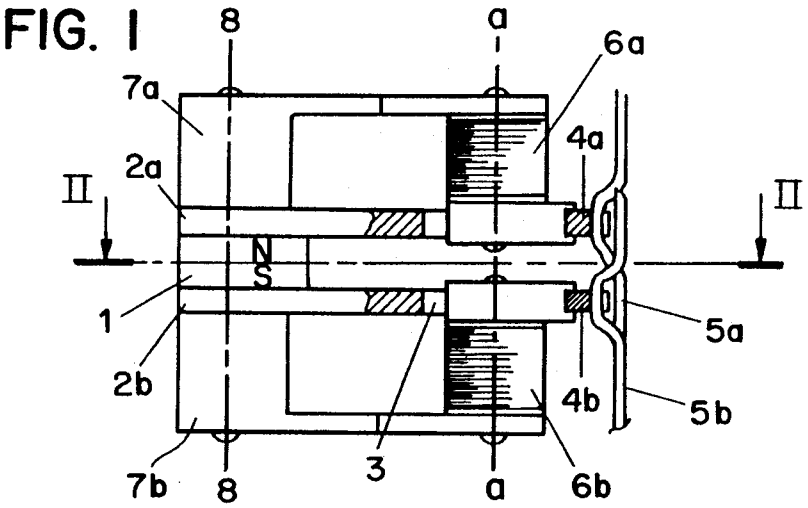
FIG. 1 is a side view of an embodiment of the present invention.
Figure 2:
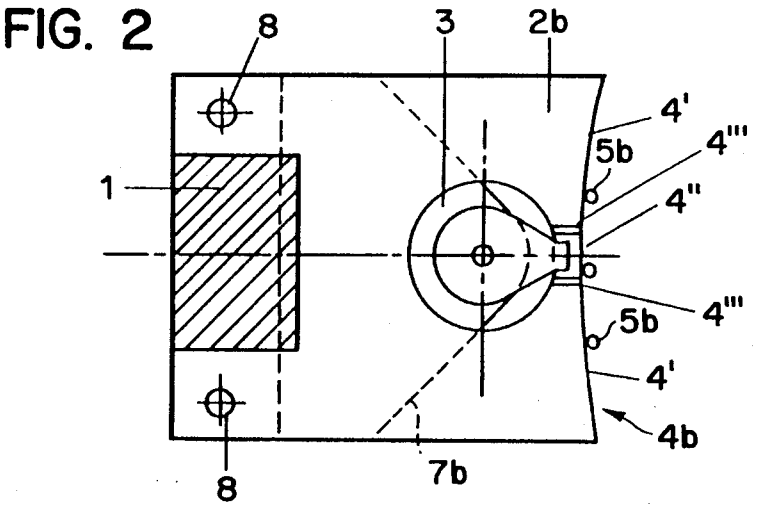
FIG. 2 is a plan view of the embodiment illustrated in FIG. 1 taken along the II—II axis.
Figure 3:
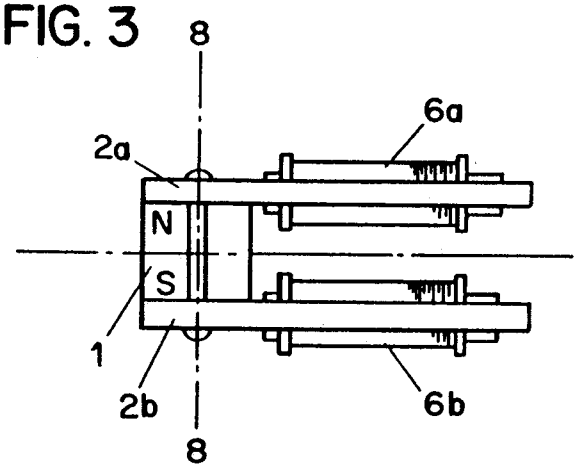
FIG. 3 is a side view of another embodiment of the present invention.
Figure 4:
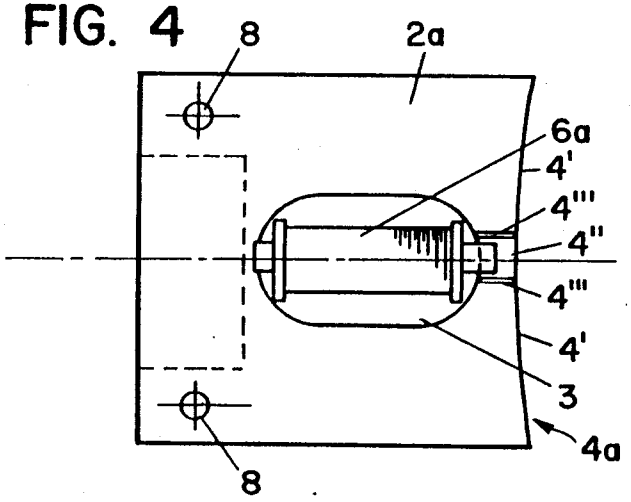
FIG. 4 is a plan view of an embodiment illustrated in FIG. 3.

The present invention is described below with reference to FIGS. 1 through 6 show a few of its typical embodiments, for the purpose of illustration but in no way limiting. According to the embodiment in FIGS. 1 and 2, the selection device uses a single permanent magnet 1, with N and S poles at its opposite bases. To these N and S bases are connected two parallel plates 2*a* and 2*b* respectively of ferromagnetic material. Each of these plates having a cavity 3 to house the electromagnetic part of the device.

The two edges 4*a* and 4*b* of the device have elements 5*a* and 5*b* to be selected running through them. Edge 4*a* selects elements 5*a* and edge 4*b* selects elements 5*b*.

Each edge 4*a* and 4*b* is made up of two end parts 4' which belong to a plate 2*a* and 2*b*, respectively and constantly have a magnetic polarity (N or S) imparted to them by permanent magnet 1, and of a central part 4'' which constitutes the pole shoe of electromagnet 6*a* and 6*b* and assumes a magnetic polarity depending on the excitation of its winding by an electric current. As previously described, elements 5*a* and 5*b* slide along an edge 4*a* or 4*b* and are loaded with an elastic force which tends to pull them away from the said edge. If electromagnet 6*a* or 6*b* is excited so as to counteract the attractive action by the pole shoes of the permanent magnet, elements 5*a* and 5*b* which slide along edges 4*a* and 4*b* in central section 4'' are no longer attracted and, due to their elastic force, become detached from the said edge. They then follow a different trajectory to those elements which instead continue to find magnetic attraction in section 4'', since electromagnet 6*a* or 6*b* is not excited in contrast to the permanent magnets. The elements thus selected are engaged by different organs placed along two different trajectories and work differently. Parts 4'' and 4' are magnetically separated by diamagnetic inserts 4'''.

Electromagnets 6*a* and 6*b* are held by supports 7*a* and 7*b* respectively and are packed in by bolts 8, which form the assembly of the device. Edges 4*a* and 4*b* may be the same and have the various parts 4', 4'' and 4''', of the same dimensions and placed at the same angular intervals, or they may be different and/or placed at different angular intervals.

In other words the device may be symmetrical in its two parts or asymmetric.

The cores and windings of electromagnets 6*a* and 6*b* may be arranged along the same axis a—a or along axes which are offset in relation to each other, and thus their pole shoes 4″ may be positioned on different angular co-ordinates in relation to the cylinder of the machine. Whereas in FIGS. 1 and 2 the *a—a* axis is essentially at right angles to plates 2*a* and 2*b*, in FIGS. 3 and 4 a different embodiment of the invention is shown, placing the axes of the electromagnets parallel to the plane of plates 2*a* and 2*b*. The arrangement shown in FIGS. 1 and 2 enables a device with a minimum distance between plates 2, while the arrangement shown in FIGS. 3 and 4 enables a device with smaller overall vertical dimensions.

Figure 5:
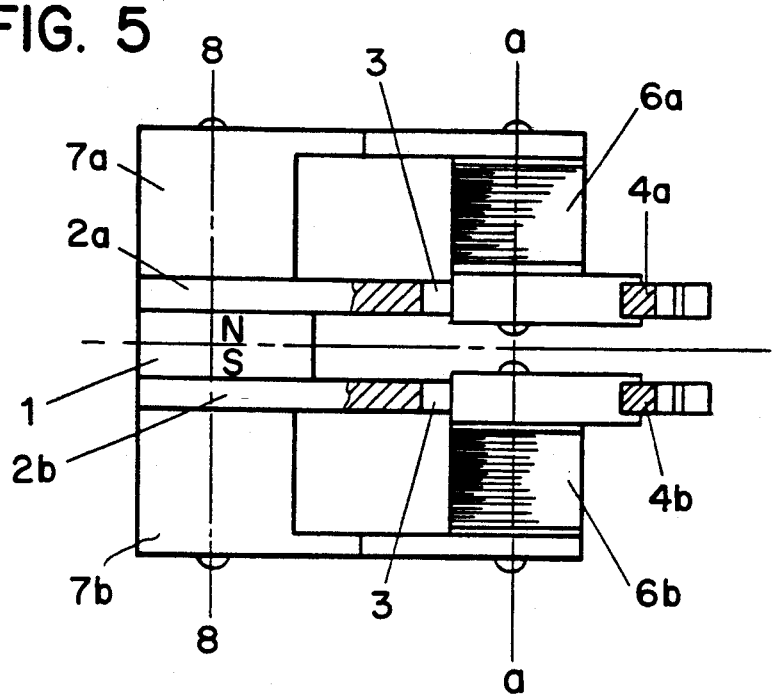
FIG. 5 is a side view of a further embodiment of the present invention.
Figure 6:
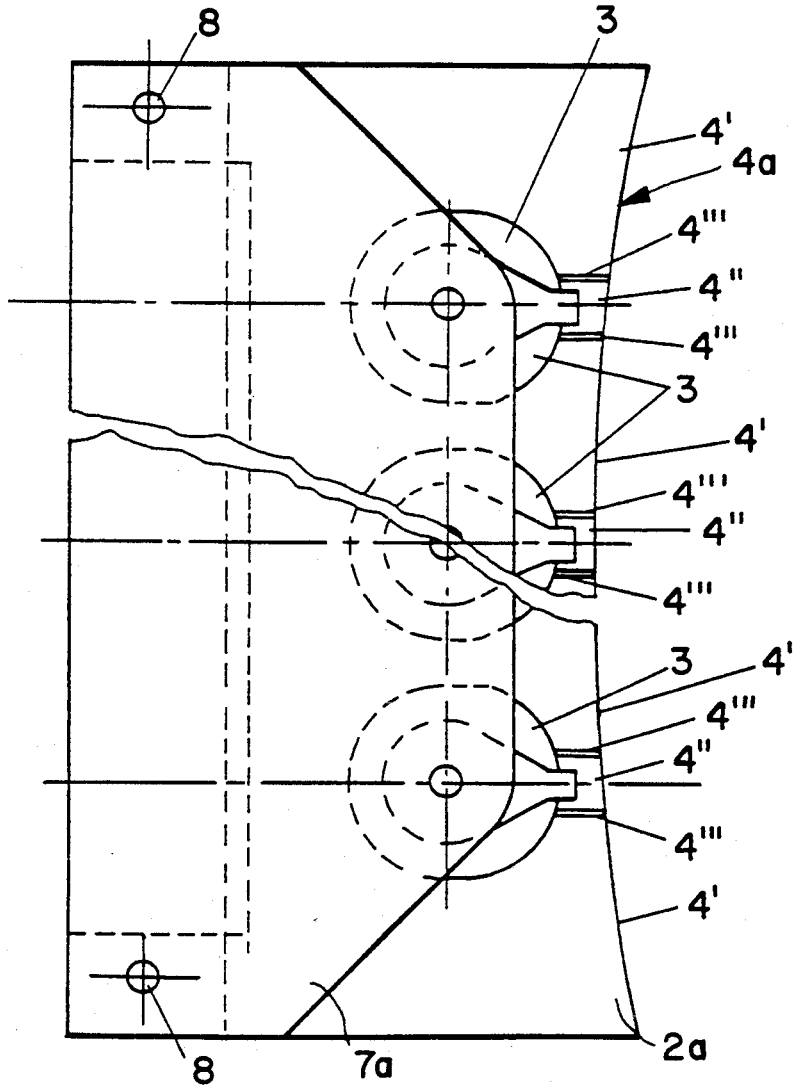
FIG. 6 is a plan view of the embodiment illustrated in FIG. 5.

FIGS. 5 and 6 shows an embodiment of the selector device according to the invention for several pairs of electromagnets 6*a* and 6*b* placed on upper and lower levels, in which a single permanent magnet 1 and, preferably, a single pair of plates 2*a* and 2*b* each with several cavities 3, and a single pair of supports 7*a* and 7*b* serve to create several pairs of selection positions, bearing several pairs of electromagnets 6*a* and 6*b*.

With this arrangement the various parts 4′, 4″, 4′ . . . 4″, 4′ of the active selection edge are alternated, the terminal parts of the plates 2*a* and 2*b* however being those connected to the permanent magnet. This arrangement enables an even more compact selector to be created, with a minimum number of parts, easier to construct and install on the machine, and with even smaller angular dimensions.

I claim:

1. A selector for electromagnetically selecting elements and for bringing the elements towards different stations; comprising:

a) a permanent magnet;

b) a first plate connected to a pole of said permanent magnet, wherein said first plate has a cavity therein and an edge divided into two parts;

c) a second plate parallel to said first plate and connected to an opposite pole of said permanent magnet, wherein said second plate has a cavity therein and an edge divided into two parts, wherein said first plate is located at a first level and said second plate is located at a second level, and wherein each of said edges of said first plate and of said second plate thereby form a path therebetween for selecting the elements;

d) a first electromagnet located in said first plate cavity;

e) a second electromagnet located in said second plate cavity;

f) a first shoe connected to said first electromagnet wherein said first shoe has an edge and is positioned between said parts of said edge of said first plate, and wherein said first shoe is magnetically isolated from said parts of said edge of said first plate; and g) a second shoe connected to said second electromagnet, wherein said second shoe has an edge and is positioned between said parts of said edge of said second plate, and wherein said second shoe is magnetically isolated from said parts of said edge of said second plate;

whereby said first and second electromagnets are selectively energized so that said edge of said first shoe and said edge of said second shoe selectively attract elements for bringing the selectively attracted elements to different stations.

2. The selector of claim 1, wherein said edge of said first shoe is adapted for selectively attracting a first set of elements and said edge of said second shoe is adapted for selectively attracting a second set of elements.

3. The selector of claims 1 or 2, wherein the axis of said first and said second electromagnets are perpendicular to the plane of said first and said second plates.

4. The selector of claims 1 or 2, wherein the axis of said first and said second electromagnets are parallel to the plane of said first and said second plates.

5. The selector of claims 1 or 2, wherein said first and second plates have a plurality of cavities, and further comprising a corresponding plurality of electromagnets located in said plurality of cavities and a corresponding plurality of shoes connected to said plurality of electromagnets, whereby said plurality of electromagnets are selectively energized so that said plurality of shoes selectively attract elements for bringing the selectively attracted elements to different stations.

* * * * *